United States Patent [19]

Tucker et al.

[11] Patent Number: 5,063,848

[45] Date of Patent: Nov. 12, 1991

[54] IGNITER BAG

[75] Inventors: Mark A. Tucker, Buncombe; Robert M. Musgrave, Marion, both of Ill.

[73] Assignee: Olin Corporation, Cheshire, Conn.

[21] Appl. No.: 598,314

[22] Filed: Oct. 16, 1990

[51] Int. Cl.[5] ..... F42B 5/30; F42B 5/38

[52] U.S. Cl. ..... 102/282; 102/430; 102/434; 102/467

[58] Field of Search ..... 102/282, 283, 430, 431, 102/433, 434, 464, 465, 466, 467

[56] References Cited

U.S. PATENT DOCUMENTS

| | | | |
|---|---|---|---|
| 588,443 | 8/1897 | Kendall | 102/430 |
| 864,725 | 8/1907 | Davis | 102/282 |
| 993,917 | 5/1911 | Völler | 102/430 |
| 1,625,631 | 4/1927 | Spotswood et al. | 102/282 |
| 2,410,435 | 11/1946 | Evans | 102/431 |
| 3,771,459 | 11/1973 | Lohnstein | 102/282 |
| 4,014,263 | 3/1977 | Plumer | 102/433 |
| 4,702,167 | 10/1987 | Reinelt et al. | 102/282 |
| 4,763,577 | 8/1988 | Romer et al. | 102/430 |

FOREIGN PATENT DOCUMENTS

| | | | |
|---|---|---|---|
| WO8912211 | 12/1989 | European Pat. Off. | 102/430 |
| 304218 | 4/1920 | Fed. Rep. of Germany | 102/282 |
| 692609 | 11/1930 | France | 102/430 |

OTHER PUBLICATIONS

"Artillery Ammunition", from Illustrated Encyclopedia of Ammunition, by V. Hogg, 1985.

*Primary Examiner*—David H. Brown

*Attorney, Agent, or Firm*—John R. Wahl

[57] ABSTRACT

An igniter bag for a cannon cartridge is disclosed which comprises a generally toroidal annular bag of combustible fabric such as cotton or rayon containing an ignition powder. The bag has a plurality of radial seams separating the bag and the powder contained therein into separate adjacent compartments within the bag so that movement of the powder within the bag is substantially restricted. This construction prevents side to side shifting of the ignition powder during storage, handling and loading of the cartridge.

11 Claims, 2 Drawing Sheets

IGNITER BAG

GOVERNMENTAL INTEREST

The invention described herein was developed under contract DAAA21-89-C-0094 and therefore may be manufactured, used and licensed by or for the Government for governmental purposes without the payment to us of any royalty thereon.

BACKGROUND OF THE INVENTION

The present invention generally relates to large caliber ammunition and more particularly to cartridges utilizing an igniter bag to contain an igniter propellant powder in position adjacent the main propellant.

Large caliber ammunition cartridges such as those carrying APFSDS projectiles typically have the projectile mounted to and extending into one end of a tubular case and an igniter assembly rigidly mounted in a metal head or base closing the other end of the case. A granular or stick propellant charge preferably fills the remaining volume of the case. When stick propellant is used, a bundle of parallel sticks of propellant are arranged axially within the cartridge case around the rear of the projectile.

The igniter assembly for a cartridge containing stick propellant includes a primer which contains a priming charge, typically NSP, Digel-RP or a black powder, in a short thimble shaped primer body which is threaded into the metal head. One or more annular fabric igniter bags containing additional igniter powder are disposed concentrically around the primer body. The bag of powder is designed to uniformly ignite the rear end of the bundle of stick propellant. Ignition of the rear end of the bundle must be uniform, symmetrical and simultaneous in order to optimize cartridge performance in the gun and minimize any possibility of overpressurization.

Testing of conventional stick propellant loads in a 120 mm cannon has recently revealed, in some rounds, undesirable axial pressure oscillations within the gun chamber during ignition. These oscillations are highly undesirable because if reinforcing they can lead to unacceptably high peak pressures. Accordingly, it is desirable that these oscillations be eliminated.

SUMMARY OF THE INVENTION

It is an object of the invention to provide a large calliber cartridge which minimizes pressure oscillations during ignition.

It is another object of the invention to provide an improved igniter bag for the igniter assembly in a stick propellant cartridge which reliably maintains the ignition charge in position against the rear end of the propellant bundle.

Additional objects, features and advantages of the invention will become apparent from a reading of the following description of the invention when taken in conjunction with the drawing and appended claims.

To achieve the foregoing objects, an igniter bag for a cannon cartridge is provided which comprises a generally flat, toroidal bag of combustible fabric such as silk, cotton or rayon and contains a granular ignition powder. The bag is preferably made of at least one folded over sheet of fabric or at least two stacked separate annular sheets of fabric each preferably having a circular inner edge and a circular outer edge. The inner edges are sewn or otherwise joined together in a conventional manner. The bag has a plurality of radial seams or baffles separating the bag and the powder contained therein into separate adjacent compartments within the bag so that movement of the powder within the bag is substantially restricted. This construction prevents side to side shifting of the ignition powder during storage, handling and loading of the cartridge. It thus ensures that the required quantity of ignition powder resides adjacent the rear end of each of the propellant sticks in the bundle so that simultaneous symmetrical ignition of the bundle is optimized.

DETAILED DESCRIPTION OF THE PREFERRED EMBODIMENTS

Figure 1:
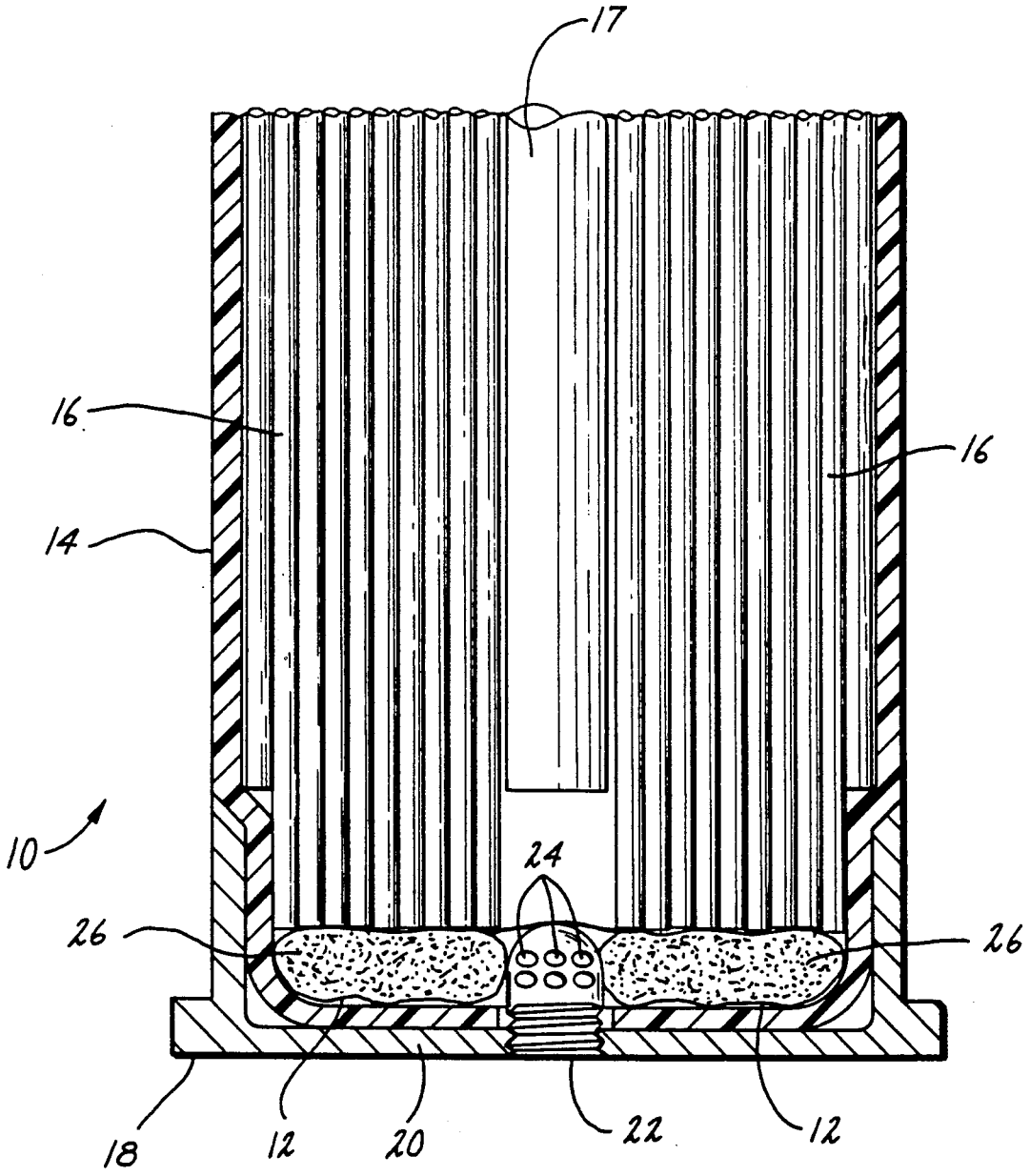
FIG. 1 is a partial sectional view of a combustible cartridge containing an igniter bag in accordance with the invention.

A combustible case cartridge 10 containing an igniter bag 12 in accordance with the invention is shown in FIG. 1. The cartridge 10 has a tubular case 14 containing a bundle of propellant sticks 16 and supports a projectile 17 from one end. The cartridge 10 has a cup shaped metal case base 18 attached to the rear end 20 of the tubular case 14. Threaded into a central bore in the base 18 is primer housing 22 which projects into the case 14 and has a plurality of radial holes 24 through and spaced around the periphery of the housing 22.

At least one flattened toroidal or doughnut shaped igniter bag 12 in accordance with the invention is mounted concentrically on the housing 22 adjacent the holes 24. The upper surface of the bag 12 butts against the rear end of the bundle of propellant sticks 16. The bag 12 contains an igniter charge 26 of an ignition powder such as NSP or a fast burning black powder. The purpose of the igniter charge 26 is to virtually instantaneously ignite the rear end of all the propellant sticks 16. The igniter charge is radially spread out adjacent the rear of the bundle by the bag construction so that the rear of the bundle is symmetrically ignited. In operation, when the primer is ignited, the primer flash passes through the holes 24 into the igniter bags 12, igniting the fast burning ignition charge 26. The burning ignition charge 26 in turn ignites the slower burning stick propellant 16.

Figure 2:
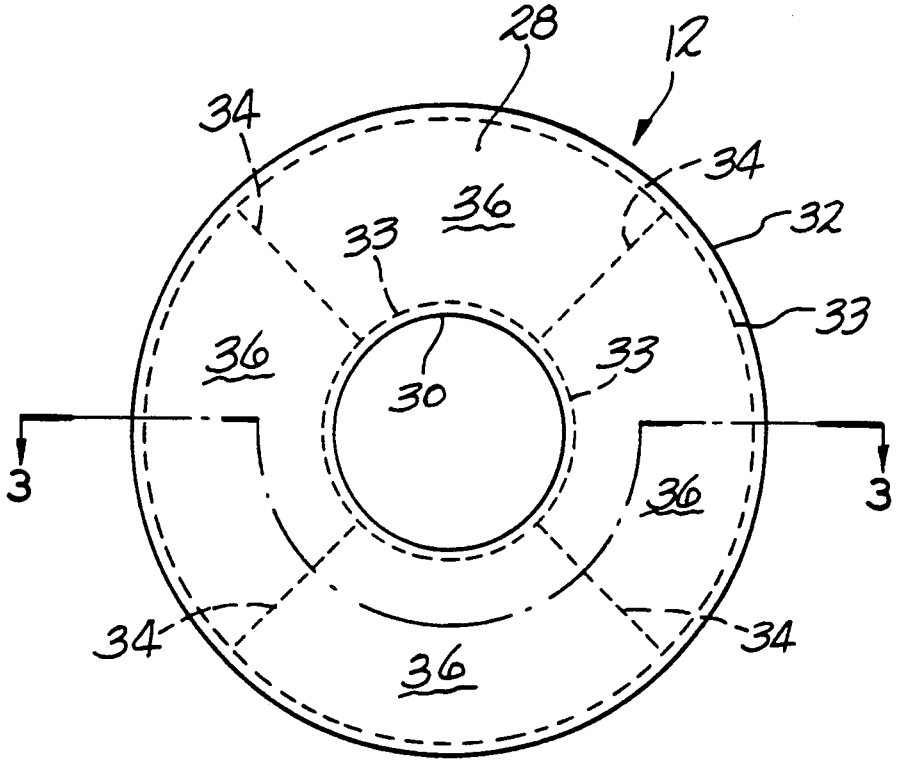
FIG. 2 is a plan view of an igniter bag in accordance with the invention.
Figure 3:
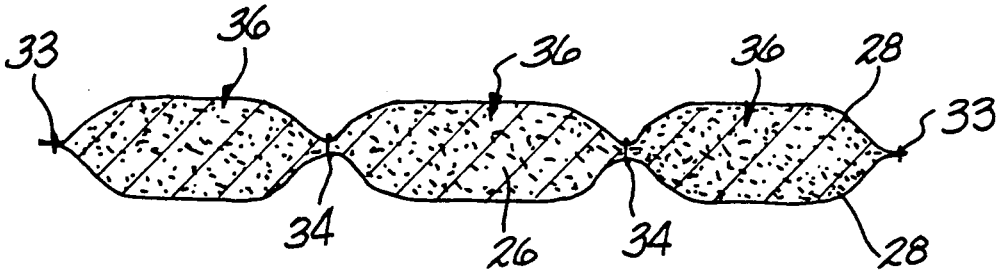
FIG. 3 is a sectional view of the igniter bag in FIG. 2 taken along the line 3—3.

One or more bags 12 may be used. If more than one ignition charge type is used, the bags may be stacked together in place of the one bag 12 shown. Each of the igniter bags 12 may be made from a single folded over sheet or a pair of sheets 28 of combustible fabric such as silk, rayon or cotton. Each sheet preferably has an annular flat shape with inner and outer circular edges 30 and 32 respectively. In the embodiment shown in FIGS. 2 and 3 the sheets 28 are sewn together by stitches 33 around the circular edges 30 and 32 and have radial stitched seams 34 which divide the bag 12 preferably into four side by side compartments 36. The number of compartments 36 may be varied from three to about six depending on the size and shape of the bag so as to ensure that the charge contained therein remains stationary within the bag. The igniter charge 26 is distributed equally throughout each of the compartments 36.

Figure 4:
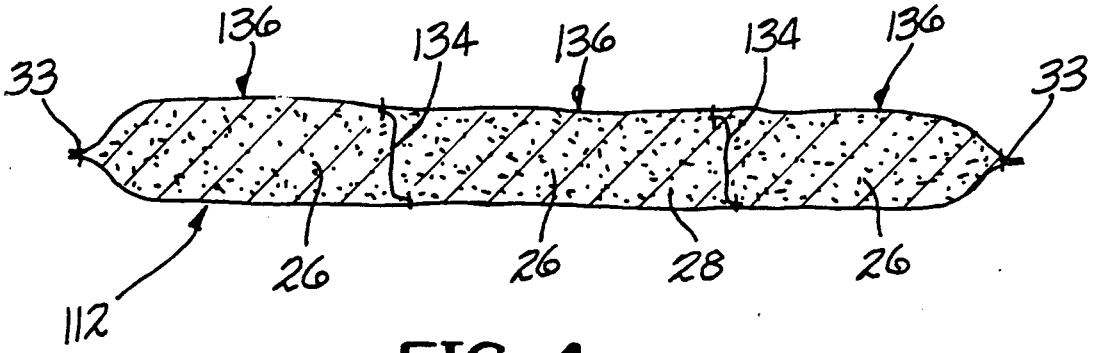
FIG. 4 is a sectional view of an alternative igniter bag in accordance with the invention taken along the same line 3—3 in FIG. 2.

An alternative embodiment of the bag in accordance with the invention is shown in FIG. 4. In this alternative embodiment of the igniter bag 112, there are radial vertical baffles 134 sewn in place to separate the individual compartments 136 instead of seams 34. The baffles 134 are made of the same fabric sheet material as the bag and gives a greater internal volume to the compartments 136 and permits a more uniform, flat outer surface contour to the bag 112 which is positioned in contact with the rear end of the tubular bundle of stick propellant 16. When a substantial volume of igniter charge is required, this alternative may be more advantageous.

Although the invention has been shown and described with reference to two preferred embodiments, other variations and modifications are contemplated as being within the scope of the invention. Accordingly it is intended to embrace all such variations and modifications as defined by the scope of the appended claims.

What is claimed is:

1. An igniter bag containing a propellant ignition charge comprising:

a pair of generally annular fabric sheets having concentric inner and outer generally circular edges joined together forming a toroidal cavity therebetween and a plurality of baffle means for dividing said cavity into separate adjacent compartments, each of said means extending from said inner edges to said outer edges.

2. The igniter bag according to claim 1 wherein each of said compartments contains a substantially equal amount of said charge.

3. The igniter bag according to claim 1 wherein said means is a fabric baffle sewn to said sheets and extending between said inner and outer edges.

4. The igniter bag according to claim 1 wherein said means is a seam formed by a stitch sewn through said sheets and extending radially between said inner and outer edges.

5. The igniter bag according to claim 4 wherein each of said compartments contains a substantially equal amount of said charge.

6. An ammunition cartridge comprising:

a tubular case having opposite ends;

a base closing one of said ends;

a bundle of stick propellant contained in said case;

a primer disposed in a central bore through said base, said primer having a portion extending into said case; and at least one generally toroidal shaped igniter bag containing an ignition charge disposed around said portion between said base and a rear end of said bundle of stick propellant so that a generally annular surface of said bag is adjacent said end, said bag having a plurality of outwardly extending baffle means for separating said ignition charge into a plurality of closed compartments.

7. The cartridge according to claim 6 wherein said compartments each have substantially identical volumes.

8. The cartridge according to claim 7 wherein each of said compartments contains an equal portion of said ignition charge.

9. The cartridge according to claim 6 wherein said bag further comprises a pair of generally annular fabric sheets having inner and outer generally circular edges joined together.

10. The cartridge according to claim 9 wherein said baffle means is a seam formed by a stitch sewn through said sheets and extending radially between said inner and outer edges.

11. The cartridge according to claim 9 wherein said baffle means is a fabric wall sewn between said sheets and extending between said edges.

* * * * *